US011749245B2

(12) United States Patent
Chen

(10) Patent No.: US 11,749,245 B2
(45) Date of Patent: Sep. 5, 2023

(54) ELECTRONIC PERCUSSION MELODY MUSICAL INSTRUMENT

(71) Applicant: Yue Chen, Beijing (CN)

(72) Inventor: Yue Chen, Beijing (CN)

(73) Assignee: Yue Chen, Beijing (CN)

( * ) Notice: Subject to any disclaimer, the term of this patent is extended or adjusted under 35 U.S.C. 154(b) by 295 days.

(21) Appl. No.: 17/109,932

(22) Filed: Dec. 2, 2020

(65) Prior Publication Data

US 2021/0398512 A1 Dec. 23, 2021

(51) Int. Cl.

| | |
|---|---|
| ***G10H 3/14*** | (2006.01) |
| ***G10D 13/02*** | (2020.01) |
| ***G10D 13/10*** | (2020.01) |
| ***G10H 1/32*** | (2006.01) |

(52) U.S. Cl.

CPC ..... *G10H 3/146* (2013.01); *G10D 13/02* (2013.01); *G10D 13/26* (2020.02); *G10H 1/32* (2013.01); *G10H 2220/525* (2013.01)

(58) Field of Classification Search

CPC .... G10H 3/146; G10H 1/32; G10H 2220/525; G10D 13/26; G10D 13/02

See application file for complete search history.

(56) References Cited

U.S. PATENT DOCUMENTS

| | | | | |
|---|---|---|---|---|
| 4,913,023 | A * | 4/1990 | Mizuguchi | G10H 3/146 84/DIG. 12 |
| 2013/0152768 | A1* | 6/2013 | Rapp | G10D 13/12 84/634 |
| 2015/0279343 | A1 | 10/2015 | Shi | |
| 2017/0032775 | A1* | 2/2017 | Schlessinger | G10H 1/0556 |
| 2021/0210055 | A1* | 7/2021 | Treacher | G10D 13/09 |

FOREIGN PATENT DOCUMENTS

| | | | |
|---|---|---|---|
| CN | 2715291 | Y | 8/2005 |
| CN | 201294088 | Y | 8/2009 |
| CN | 107818774 | A | 3/2018 |
| CN | 109360545 | A | 2/2019 |
| CN | 110021282 | A | 7/2019 |
| CN | 110895919 | A | 3/2020 |
| CN | 111583892 | A | 8/2020 |

(Continued)

*Primary Examiner* — Jianchun Qin

(74) *Attorney, Agent, or Firm* — Dragon Sun Law Firm, PC; Nathaniel Perkins

(57) ABSTRACT

The present invention provides an electronic percussion melody musical instrument, comprising: a key module including a plurality of keys each arranged to receive a knock from the outside, and a plurality of energy conversion units each configured to sense mechanical energy generated by the knocking of the key and convert the mechanical energy into electrical energy in the form of an electrical signal; a storage unit configured to store sound source data associated with the plurality of keys; an output unit configured to output a sound signal corresponding to the sound source data; and a control unit configured to: receive the electrical signal from the energy conversion unit; acquire the sound source data associated with the electrical signal from the storage unit according to the electrical signal; and control the output unit to output the sound signal corresponding to the sound source data.

16 Claims, 5 Drawing Sheets

(56) References Cited

FOREIGN PATENT DOCUMENTS

| | | | | |
|---|---|---|---|---|
| CN | 111583893 | A | | 8/2020 |
| CN | 111986639 | A | | 11/2020 |
| JP | 10333672 | A | * | 12/1998 |
| JP | 10333672 | A | | 12/1998 |
| TW | M274613 | U | | 9/2005 |
| TW | 200617881 | A | | 6/2006 |
| TW | 201201194 | A | | 1/2012 |

* cited by examiner

ELECTRONIC PERCUSSION MELODY MUSICAL INSTRUMENT

CROSS-REFERENCE TO RELATED APPLICATIONS

The present application claims priority for Invention Patent Application No. 202010561579.4, entitled "Electronic percussion melody musical instrument" submitted to the National Intellectual Property Administration, PRC on Jun. 18, 2020, which is incorporated herein by reference in its entirety.

TECHNICAL FIELD

The present application generally relates to the field of musical instruments. More particularly, the present invention relates to an electronic percussion melody musical instrument.

BACKGROUND

A traditional percussion melody musical instrument makes a sound by hitting a key made of a vibration material, and processes the sound by means of amplification or the like through a resonance box. Since some of the vibration materials are chosen from very precious wood, the instrument as a whole is expensive. In addition, the volume of the instrument is too large to be portable due to the presence of the resonance body.

During playing, the existing electronic percussion melody musical instrument generates an electrical signal related to the sound by controlling ON of a circuit switch through the knocking of the key. The electrical signal generated in this way usually cannot well reflect the influence of the pressing or knocking force of the key on the tone and timbre, thereby affecting the playing effect of the electronic percussion melody musical instrument. In addition, the existing electronic percussion melody musical instrument has low sensitivity, single functions and few external interfaces, and thus cannot meet various functional requirements of players on the electronic percussion melody musical instrument.

SUMMARY

To address at least one or more of the problems in the Background, the present invention provides a novel electronic percussion melody musical instrument. The musical instrument adopts an energy conversion unit to convert mechanical energy generated by knocking a key into electric energy in a current form, and can generate currents with different magnitudes according to different knocking forces. Further, the electronic percussion melody musical instrument of the present invention employs a control unit capable of supporting various signal processing and control, thereby enhancing the processing capability of music signals. In addition, the electronic percussion melody musical instrument of the present invention has various external interfaces so as to meet different players' different use requirements for the musical instrument.

Specifically, the present invention discloses an electronic percussion melody musical instrument. The musical instrument comprises: a key module including a plurality of keys each arranged to receive a knock from the outside, and a plurality of energy conversion units each configured to sense mechanical energy generated by the knocking of the key and convert the mechanical energy into electrical energy in the form of an electrical signal; a storage unit configured to store sound source data associated with the plurality of keys; an output unit configured to output a sound signal corresponding to the sound source data. The musical instrument further comprises a control unit configured to: receive the electrical signal from the energy conversion unit; acquire the sound source data associated with the electrical signal from the storage unit according to the electrical signal; and control the output unit to output the sound signal corresponding to the sound source data.

In one embodiment, the musical instrument further comprises a body configured to accommodate the control unit, the output unit, and the storage unit, the key module further includes a conductive structure that includes a stress panel supporting the keys and a pressure-bearing bottom plate on one side of the body. The energy conversion unit is arranged between the stress panel and the pressure-bearing bottom plate. The plurality of keys are arranged in at least two rows, wherein the first row is a semitone region and the second row is a whole tone region, and the keys are further arranged by one of: a support arranged on the stress panel and configured to support and fix the keys; or the key includes a bottom surface fitting the stress panel and two side parts, wherein inner surfaces of the two side parts are in surface contact with end surfaces of the stress panel and the pressure-bearing bottom plate and are partially inserted into the body to support and fix the keys.

In another embodiment, a vibration-proof material for preventing the energy conversion unit from vibrating is filled between the stress panel and the pressure-bearing bottom plate.

In another embodiment, the energy conversion unit comprises one or more of a piezoelectric ceramic sensor, a pressure sensitive sensor, a flexible bending sensor, and a vibration sensor.

In one embodiment, the electronic percussion melody musical instrument further comprises an A/D conversion module configured to convert an analog electrical signal output from the energy conversion unit into a digital electrical signal and output the digital electrical signal to the control unit.

In another embodiment, the electronic percussion melody musical instrument further comprises a filtering module configured to filter the digital electrical signal and send the filtered digital electrical signal to the control unit.

In one embodiment, the sound source data comprises data relating to timbre and/or sound effect of at least one musical instrument. In another embodiment, the at least one musical instrument comprises one or more of a xylophone, a vibraphone and a marimba.

In another embodiment, the electronic percussion melody musical instrument further comprises a transmission interface configured to enable the electronic percussion melody musical instrument to interact with an external device to provide extended functionality of the electronic percussion melody musical instrument, wherein the transmission interface comprises a wired transmission interface and/or a wireless transmission interface so as to provide a wired and/or wireless connection with the external device.

In yet another embodiment, the electronic percussion melody musical instrument further comprises a control panel and a power module, wherein the control panel is connected to the control unit and is configured to perform a function setting on the electronic percussion melody musical instrument, and the power module is configured to supply power to the electronic percussion melody musical instrument.

The electronic percussion melody musical instrument of the present invention better addresses the problems that the existing electronic percussion melody musical instrument is insensitive to the pressure signal of the knocking of the key or cannot identify the magnitude of the pressure signal. Meanwhile, the electronic percussion melody musical instrument of the present invention can also adopt wireless modules such as Bluetooth and the like to communicate with external equipment, and is also provided with a multifunctional panel, so that the electronic percussion melody musical instrument of the present invention has a reduced volume and is convenient for players to play. In addition, the electronic percussion melody musical instrument also has advantages such as low cost, good timbre, good hand feeling, strong anti-interference capability.

BRIEF DESCRIPTION OF THE DRAWINGS

The above-described features of the present invention will be better understood and its numerous objects, features, and advantages will become apparent to those skilled in the art by reading the following detailed description with reference to the accompanying drawings. The drawings illustrated as follows are merely some of the embodiments of the present disclosure. For an ordinary skilled in the art, he or she may also acquire other drawings according to such drawings without paying inventive efforts, in which.

DETAILED DESCRIPTION

The technical solutions in the embodiments of the present disclosure will be clearly and completely described below with reference to the accompanying drawings in the embodiments of the present disclosure. Obviously, the described embodiments are only a part of the embodiments of the present disclosure instead of all of them. All other embodiments that are obtainable to those skilled in the art based on the embodiments of the present disclosure without any creative effort are included in the protection scope of the present disclosure.

Figure 1:
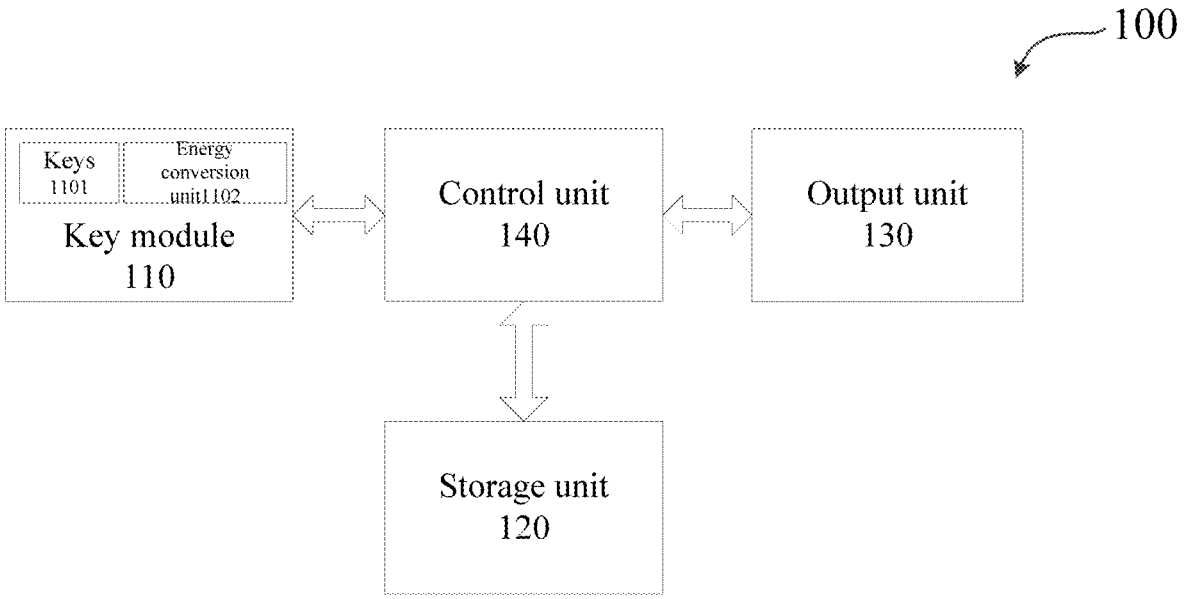
FIG. 1 is a block diagram schematically showing the composition of an electronic percussion melody musical instrument according to an embodiment of the present invention.

FIG. 1 is a block diagram schematically showing the composition of an electronic percussion melody musical instrument 100 according to an embodiment of the present invention. As shown in FIG. 1, the electronic percussion melody musical instrument 100 of the present invention may comprise a key module 110, a storage unit 120, an output unit 130, and a control unit 140, wherein the key module may include a plurality of keys 1101 and a plurality of energy conversion units 1102. Further, each of the keys is arranged to receive a knock from the outside, and each of the plurality of energy conversion units is configured to sense mechanical energy generated from the knocking of the key and convert the mechanical energy into electrical energy in the form of an electrical signal.

In one embodiment, the storage unit may be configured to store sound source data associated with the plurality of keys. In one application scenario, the sound source data may include data related to the timbre and/or sound effect of at least one musical instrument, for example. According to the solution of the present invention, the at least one musical instrument may comprise but is not limited to one or more musical instruments of xylophone, vibraphone and marimba. Further, the electronic percussion melody musical instrument of the present invention can exhibit the same performance effects as the existing various percussion melody musical instruments according to the difference in the sound source data or the difference in the arrangement of the key modules.

In one embodiment, the output unit may be configured to output a tone signal corresponding to the sound source data. In one application scenario, the output unit may be a speaker including a power amplifier, so that the sound signal is amplified and played back in the form of sound.

In one embodiment, the control unit may be configured to perform the following operations: first, the control unit receives the electrical signal from the energy conversion unit; then, the control unit may acquire the sound source data associated with the electrical signal from the storage unit based on the electrical signal; finally, the control unit may send the sound source data to the output unit, and then control the output unit to output the sound signal corresponding to the sound source data.

Figure 2:
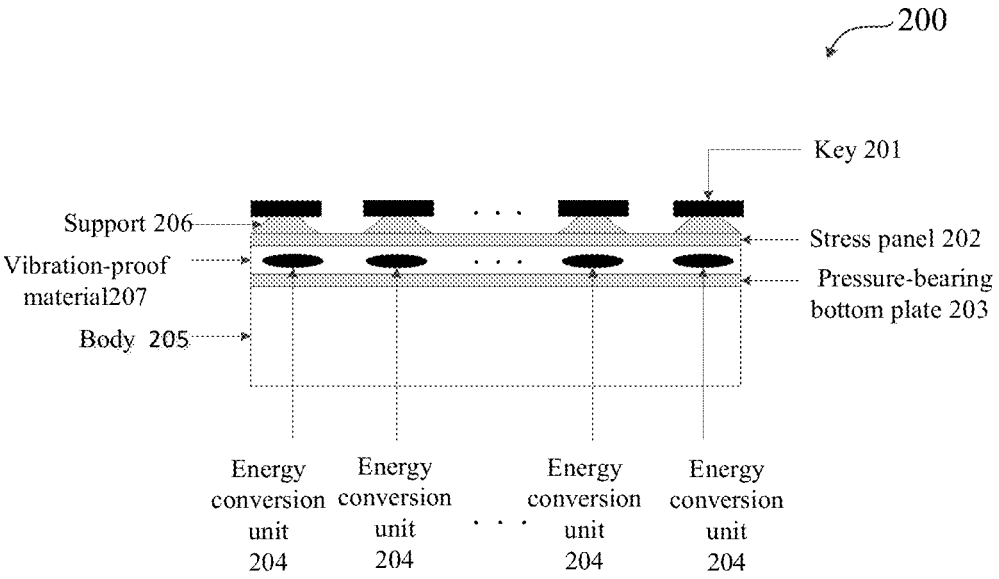
FIG. 2 is an exemplary structural view showing a key module of the electronic percussion melody musical instrument according to an embodiment of the present invention.

FIG. 2 is an exemplary structural view showing a key module 200 of the electronic percussion melody musical instrument according to an embodiment of the present invention. As shown in FIG. 2, the key module 200 of the electronic percussion melody musical instrument of the present invention may include: a plurality of keys 201, a conductive structure composed of a stress panel 202 close to the keys and a pressure-bearing bottom plate 203, a plurality of energy conversion units 204, a body 205, a support 206, and a vibration-proof material 207. Exemplary components of the key module will be described in detail below with reference to FIGS. 2 and 3, respectively.

Figure 3:
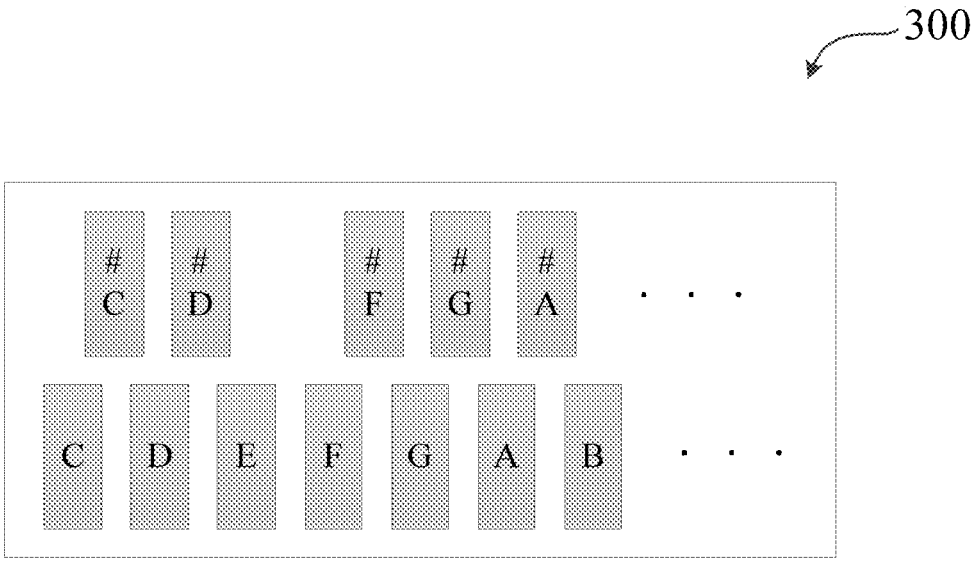
FIG. 3 is a schematic view showing the arrangement of keys of an electronic percussion melody musical instrument according to an embodiment of the present invention.

FIG. 3 is a schematic diagram showing the arrangement of keys 300 of the electronic percussion melody musical instrument according to an embodiment of the present invention. As shown in FIG. 3, in one embodiment, the plurality of keys may be made of a composite material and may be arranged in two rows, wherein the first row may be provided as a semitone region, e.g., an upper row consisting of note numbers #C, #D, #F, #G, and #A . . . as shown in FIG. 3; while the second row may be provided as a whole tone region, e.g., a lower row consisting of note numbers C, D, E, F, G, A and B . . . as shown in FIG. 3.

In one or more embodiments, the energy conversion unit of the present invention may comprise one or more of a piezoelectric ceramic sensor, a pressure sensitive sensor, a flexible bending sensor, and a vibration sensor. The said various sensors can be flexibly arranged according to different requirements for the key stroke sensitivity. In one embodiment, the energy conversion unit may be a plurality of piezoelectric ceramic sensors, and the sensors are devices that convert the pressure (or strain) generated by knocking the key into current (or charge) by using the piezoelectric effect of piezoelectric ceramics, and output it, wherein the piezoelectric ceramics are key components in the piezoelectric ceramic sensors. From the perspective of signal conversion, the piezoelectric ceramic acts as a charge generator. When the piezoelectric ceramic is subjected to an external force, the piezoelectric ceramic will generate a deformation and release an electric charge due to the deformation, and thereby generate and output a current.

The piezoelectric ceramic sensor can generate currents with different magnitudes according to different pressures. Therefore, the electronic percussion melody musical instrument can make sounds with different volumes according to different forces with which the player knocks the keys, so that the electronic percussion melody musical instrument has a sound effect closer to that of a traditional percussion musical instrument in the playing process. In addition, a range of the force with which the player knocks the key can be increased by increasing the sensitivity of the piezoelectric ceramic sensor. Here, the sensitivity of the piezoelectric ceramic sensor refers to the ratio of a small output current increment to a corresponding input small pressure increment. The larger the ratio is, the higher the sensitivity of the piezoelectric ceramic sensor is, so that performance of players with different knocking forces can be satisfied.

The body may be a cavity structure, and may be made of a metal or composite material. In the cavity, the storage unit, the output unit, the control unit, the power module and other accessory circuit boards or modules may be included. An external surface of the body can be also provided with a control panel and various transmission interfaces so as to facilitate the performance of players.

Figure 4:
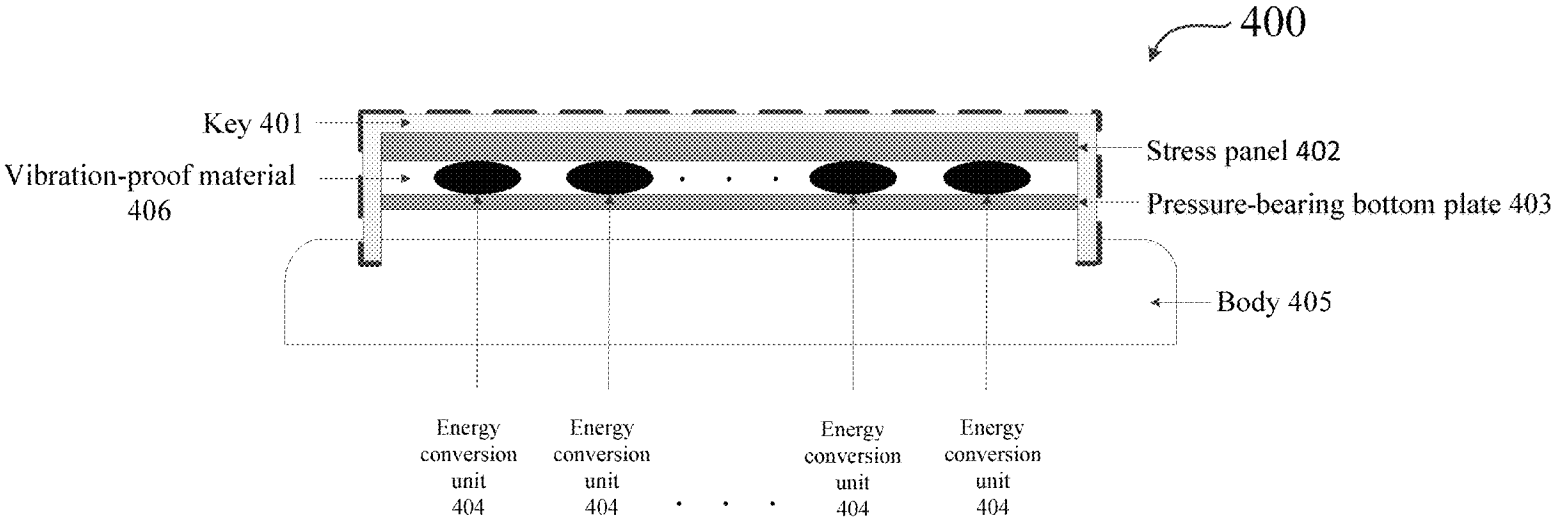
FIG. 4 is another exemplary structural view showing a key module of the electronic percussion melody musical instrument according to an embodiment of the present invention.

FIG. 4 is another exemplary structural view showing a key module of the electronic percussion melody musical instrument according to an embodiment of the present invention. As shown in FIG. 4, the key module 400 of the electronic percussion melody musical instrument of the present invention may include a plurality of keys 401, a conductive structure composed of a stress panel 402 and a pressure-bearing bottom plate 403, a plurality of energy conversion units 404, a body 405, and a vibration-proof material 406. Unlike the structure of the key module in FIG. 2, the keys, the body, and the conductive structure of the key module in FIG. 4 may be a tightly-coupled integrated structure.

Specifically, the conductive structure comprises a stress panel configured to support the keys and a pressure-bearing bottom plate on one side of the body, the energy conversion unit being arranged between the stress panel and the pressure-bearing bottom plate. The key comprises a bottom surface fitting the stress panel, and two side parts, which may be made of one or more composite or natural materials, preferably rubber. The keys may be arranged in the following manner: inner surfaces of the two side parts are in surface contact with end surfaces of the stress panel and the pressure-bearing bottom plate, and are partially inserted into reserved hole positions of the body so as to fix the body and the keys. For the layout among the plurality of keys, the energy conversion unit, the body, and the vibration-proof material, please see the corresponding description of the body module in FIG. 2, which is not repeated herein. The operation principles of the body module shown in FIG. 4 will be briefly described below.

When the keys are knocked to play, the keys are subjected to pressure to generate a tiny deformation; due to the tight coupling among the keys, the body and the conductive structure, the pressure generated by the tiny deformation is delivered to the energy conversion unit through the conductive structure, and the pressure is converted into an electrical signal by the energy conversion unit and is output to the control unit of the musical instrument. In one embodiment, in order to increase the sensitivity of the energy conversion unit, a plurality of energy conversion units as shown in FIG. 4 may be further provided corresponding to one key. With the scheme of the key module of the present invention shown in FIG. 4, the key module is made safe and reliable, and the volume of the electronic percussion melody musical instrument of the present invention is further reduced.

Figure 5:
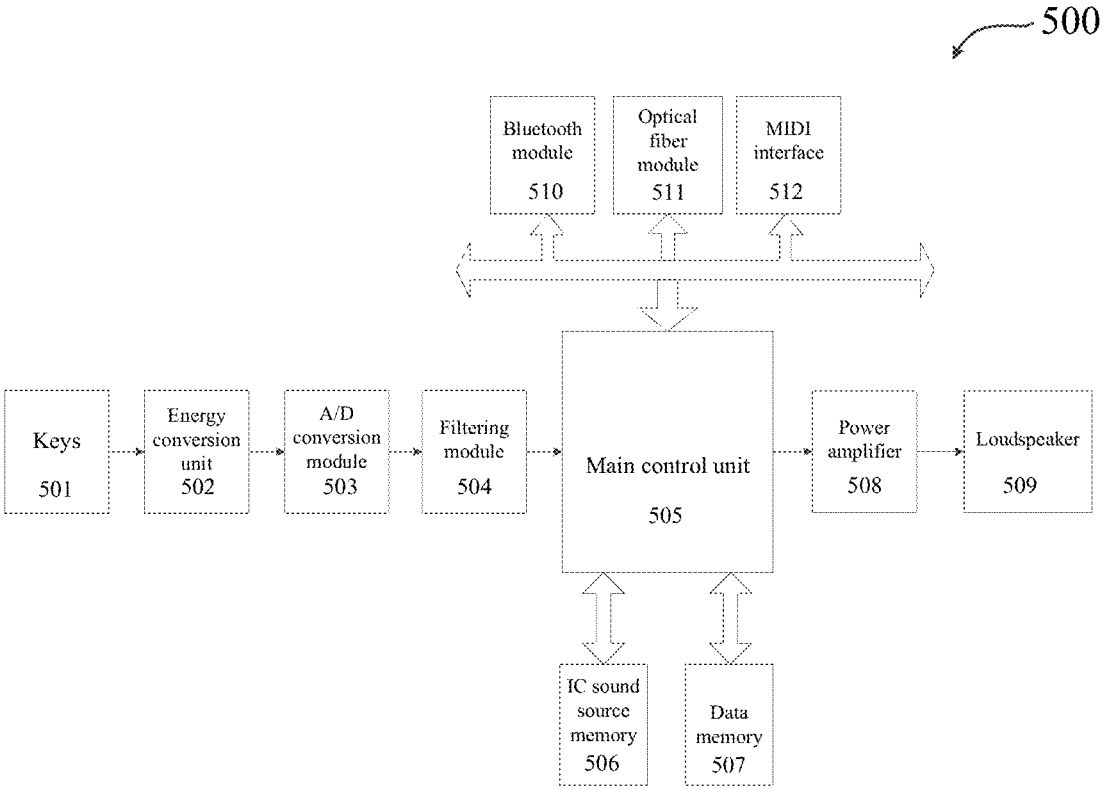
FIG. 5 is a block diagram showing the composition of an electronic percussion melody musical instrument according to an embodiment of the present invention.

FIG. 5 is a block diagram showing the composition of an electronic percussion melody musical instrument 500 according to an embodiment of the present invention. It will be appreciated that the electronic percussion melody musical instrument 500 shown in FIG. 5 is an exemplary embodiment of the electronic percussion melody musical instrument 100 shown in FIG. 1 and includes more implementation details. Therefore, the description of the electronic percussion melody musical instrument 100 in the foregoing is also applicable to the scheme of the electronic percussion melody musical instrument 500, and the same contents will not be described in detail.

As shown in FIG. 5, the electronic percussion melody musical instrument 500 of the present invention may comprise keys 501, an energy conversion unit 502, an A/D conversion module 503, a filtering module 504, a main control unit 505, an IC sound source memory 506, a data memory 507, a power amplifier 508, a loudspeaker 509, a Bluetooth module 510, an optical fiber module 511, and a MIDI interface 512.

In one embodiment, the A/D conversion module includes an A/D conversion chip and its accessory circuits, configured to convert an analog electrical signal output by the energy conversion unit into a digital electrical signal and input the digital electrical signal to the control unit. Specifically, the A/D conversion functions to convert an analog signal continuous in time and amplitude into a digital signal discrete in time and amplitude. Typically, the A/D conversion requires 4 processes of sampling, holding, quantizing, and encoding. In practical circuits, some of the above-mentioned processes may be combined, for example, quantizing and encoding are often implemented simultaneously in the conversion process.

In one embodiment, the filtering module may include a filter and its accessory circuits, configured to filter the digital electrical signal and send the filtered digital electrical signal to the control unit. During the playing of the electronic percussion melody musical instrument, due to electrical characteristics of electronic components, low-frequency or high-frequency interference signals possibly will be produced in the circuits, and these interference signals possibly will affect reception of useful signals related to the knocking of the keys. Therefore, the digital electrical signal output by the A/D conversion module can be processed by a filter, for example, composed of a resistor and a capacitor, so as to filter out the interference signals therein, and ensure normal reception of the useful signals.

In one embodiment, the memory of the present invention may include an IC audio source memory and a data memory, wherein the IC sound source memory is configured to store sound source data associated with the plurality of keys, the sound source data including, but not limited to, data relating to timbre and/or sound effect of one or more of a xylophone, a vibraphone and a marimba. The internal configuration of the IC sound source memory will be briefly described below with reference to FIG. 5.

Figure 6:
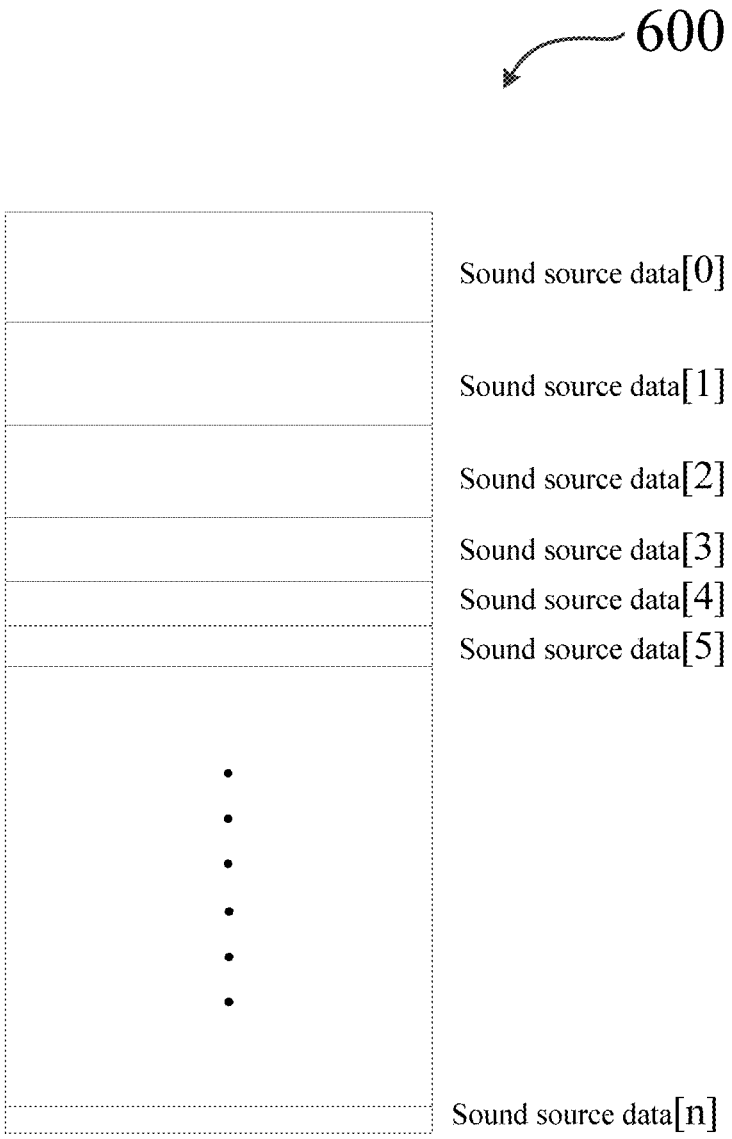
FIG. 6 shows an internal configuration of an IC sound source memory according to an embodiment of the present invention.

FIG. 6 shows an internal configuration of an IC sound source memory 600 according to an embodiment of the present invention. As shown in FIG. 6, the IC sound source memory stores waveform data of sound source data [0] to sound source data [n], where the sound source data [0] is waveform data of the lowest pitch and the sound source data [n] is waveform data of the highest pitch, and the magnitude of n depends on the number of keys. When the sound source data is stored with the same number of wavelengths, since the wavelength of bass is longer, the sound source data corresponding to a lower note number is longer than the sound source data corresponding to a higher note number, and thus occupies a larger storage space in the IC sound source memory. In one embodiment, the sound source data corresponds at a one-to-one basis to the keys shown in FIG. 3, for example, the sound source data [0] may correspond to the note number C of the key shown in FIG. 3, the sound source data [1] may correspond to the note number D of the key shown in FIG. 3, and so on.

In one embodiment, the data storage device is configured to store programs and data related to controlling the operations of the musical instrument related modules and units, and may also store other music data related to performance. The data storage device is connected with the main control unit through a bus, and can comprise a plurality of groups of storage units, each connected with the main control unit through the bus.

In one embodiment, the master control unit of the present invention may be implemented using, for example, a digital signal processor ("DSP"). The DSP is a microprocessor suitable for performing digital signal processing operations, and is mainly applied to rapidly implement various digital signal processing algorithms in real time. For the present invention, the DSP is adopted as the main control unit to process the audio signal rapidly in real time. Specifically, firstly, the DSP receives the digital electrical signal output from the energy conversion unit and subjected to A/D conversion and filtering; then, the DSP acquires sound source data associated with the digital electrical signal from the IC sound source memory according to the digital electrical signal; finally, the DSP sends the sound source data to the output unit so as to output a sound signal corresponding to the sound source data.

In one embodiment, the power amplifier may be comprised of three parts: a preamplifier circuit, a drive amplifier circuit and a final power amplifier circuit. The pre-amplifier circuit is configured for impedance matching, has advantages of high input impedance and low output impedance, and thus can receive and transmit current signals of the audio source data with a data loss as small as possible. The drive amplifier circuit is configured to further amplify the current signal transmitted by the preamplifier circuit into a signal with medium power, so as to drive the final power amplifier circuit to normally work. The final power amplifier circuit plays a key role in the power amplifier, and its technical index decides the technical index of the whole power amplifier, and the final power amplifier circuit is configured to amplify the current signal transmitted by the drive amplifier circuit into a high-power signal so as to drive a loudspeaker to play sound.

In one embodiment, the loudspeaker may include a magnet, a frame, a centering disk, a diaphragm folded cone, and the like. Alternatively, the loudspeaker may further include the power amplifier described above. The loudspeaker, commonly known as a "horn", is a transducer capable of converting electrical signals into acoustic signals. Specifically, the audio electrical signal causes the cone or diaphragm of the loudspeaker to vibrate and resonate with the surrounding air to make a sound, by means of the electromagnetic, piezoelectric or electrostatic effect. Alternatively, the loudspeaker may be disposed outside the electronic percussion melody musical instrument of the present invention, and may be wirelessly connected to the electronic percussion melody musical instrument of the present invention by means of a wireless communication technique such as Bluetooth.

In one embodiment, the electronic percussion melody musical instrument of the present invention may further comprise a transmission interface, configured to enable the electronic percussion melody musical instrument to interact with an external device to provide extended functionality of the electronic percussion melody musical instrument, wherein the transmission interface comprises a wired transmission interface and/or a wireless transmission interface to provide a wired and/or wireless connection with the external device. As a specific implementation, the wired transmission Interface may be, for example, one or more of a music Instrument Digital Interface (MIDI), a General-purpose I/O (General-purpose input/output (GPIO)) Interface, a High-Speed Serial Computer Extended Bus (Peripheral Component Interconnect Express (PCIE)) Interface, a Serial Peripheral Interface (SPI), and an optical fiber interface, as required.

The wired transmission interface is electrically connected with the main control unit, so as to realize data transmission between the musical instrument and the external device (such as a server, a computer or other musical instruments). In one embodiment, the wired transmission interface may be, for example, a standard PCIE interface. The data to be processed is transmitted to the computer through the standard PCIE interface by the main control unit, and then the audio signals output by the musical instrument of the present invention are controlled and edited etc. through the computer.

In another embodiment, the wired transmission interface may also be a MIDI interface. MIDI is a standard for digital music, defines various notes or playing codes for a playing device such as an electronic musical instrument, and allows the electronic musical instrument, the computer or other playing devices to be connected, adjusted and synchronized with each other so as to exchange playing data among the musical instruments in real time. In one embodiment, the MIDI interface is configured for data communication between the electronic percussion melody musical instrument of the present invention and a musical instrument provided with a MIDI interface, thereby enabling joint performance among a plurality of musical instruments.

In yet another embodiment, the wired transmission interface may also be an optical fiber interface including an optical module configured for data transmission between the musical instrument of the present invention and an external device. Specifically, the optical module may include a light emitting module and a light receiving module. In one application scenario, in one aspect, the electrical signal of the data transmitted from the main control unit of the musical instrument of the present invention is processed by a driving chip inside the light emitting module, so as to drive a Semiconductor Laser (LD) or a Light Emitting Diode (LED) to emit a modulated optical signal at a corresponding rate, and couple the optical signal into an optical fiber for transmission to an external device through the optical fiber. On the other hand, the optical signal of the data transmitted by the external device is processed by an optical detection diode and an amplifier in the light receiving module, so as to output that the electrical signal with the corresponding code rate, and transmit the electrical signal to the main control unit. The data transmission between the musical instrument of the present invention and the external device is carried out through optical signals, so that the defect of large attenuation in electrical signal transmission can be effectively overcome, and the data transmission is faster, and has stronger anti-interference capability, thereby improving the quality of signal transmission.

In another embodiment, the wireless transmission interface may be one or more of a Bluetooth interface, an infrared interface, a WIFI interface, and the like, for example, as required. The wireless transmission interface is connected with the main control unit in a wireless mode, thereby achieving data transmission between the musical instrument and the external device (such as a server, a computer or other musical instruments). In one embodiment, the wireless transmission interface may be, for example, a Bluetooth interface including a Bluetooth module, and the Bluetooth interface may be configured to connect the musical instrument of the present invention and an external loudspeaker, where the Bluetooth module is disposed in both the musical instrument and the loudspeaker, so as to conveniently and flexibly position the external loudspeaker according to the requirement of live performance.

In one embodiment, the electronic percussion melody musical instrument of the present invention may further comprise a control panel connected to the control unit through a line interface and configured to perform functional setting on the electronic percussion melody musical instrument. In one embodiment, the control panel may include, for example, a display screen, a switching key for different types of musical instrument, a volume key, and other functional modules. The display screen is configured to display a performance status of the current percussion melody musical instrument. The switching key for different types of musical instruments can be configured to select playing modes of different types of percussion melody musical instruments such as xylophone, marimba or vibraphone and the like. The volume key is connected with the power amplifier and is configured to control the magnitude of the sound signal.

In one embodiment, the electronic percussion melody musical instrument of the present invention may further comprise a power module, which can supply power to the electronic percussion melody musical instrument in various ways, For example, without limitation, the musical instrument may be powered by being externally connected to mains power and a transformer unit is disposed inside the power module. The musical instrument can also be powered by arranging a power adapter. In addition, a battery box can be arranged on the musical instrument body, and the musical instrument is powered through a dry battery.

The operation principles of the electronic percussion melody musical instrument of the present invention will be described in detail below by taking the key module shown in FIG. 2 as an example.

When a player wants to use the electronic percussion melody musical instrument of the present invention as a xylophone, he can set the electronic percussion melody musical instrument of the present invention as a xylophone by means of key press on the control panel. The performance starts, and the player knocks a key with a hammer, for example, knocks a key represented by the note number C. The pressure generated by the knocking is transferred to the piezoelectric ceramic sensor through a conductive mechanism, and the piezoelectric ceramic sensor releases electrons due to the piezoelectric effect and converts mechanical energy generated by the knocking into electric energy in the form of analog electrical signal. At the same time, the key of the knocked note number C rapidly stops vibrating under a combined action of the vibration-proof composite material and the support within the conductive mechanism, and is rapidly bounced back to the pre-knocked state so as to wait for the next knock.

Then, the A/D conversion module receives the analog electrical signal sent by the piezoelectric ceramic sensor, and converts the analog electrical signal into a digital electrical signal after a series of processes such as sampling, quantizing and encoding. Then, the digital electrical signal is processed by a filtering module so as to effectively filter out high-frequency and low-frequency interference signals therein. Then, the digital electrical signal related to the key of the note number C, after being processed by the filtering module, is transmitted to the main control unit. Then, the main control unit performs table lookup in the IC sound source memory to acquire the sound source data [0] associated with the key of the sound source number C. Then, the main control unit outputs the sound source data [0] to the power amplifier.

Then, the power amplifier processes the received sound source data [0] signal through a pre-amplifier circuit, a drive amplifier circuit and a final power amplifier circuit respectively and sequentially, and finally amplifies the sound source data [0] signal. The amplified sound source data [0] signal can be transmitted to the loudspeaker in a wired or wireless mode for playing, so that a listener can listen to the sound generated by knocking the key of the sound source number C. If a player needs to connect the electronic percussion melody musical instrument of the present invention to a computer or other electronic musical instruments so as to perform music learning or joint playing through an APP software, it can be connected to the above-mentioned devices through a Bluetooth module or a MIDI interface.

It should be understood that the terms "first," "second," "third," and "fourth," etc. in the claims, description, and drawings of the present invention are used for distinguishing between different objects and not for describing a particular order. The terms "comprise" and "include," when used in the description and claims of the present invention, specify the presence of the stated features, integers, steps, operations, elements, and/or components, but do not preclude the presence or addition of one or more other features, integers, steps, operations, elements, components, and/or combinations thereof.

It is also to be understood that the terminology used in the description of the present invention herein is for the purpose of describing particular embodiments only, and is not intended to limit the present invention. As used in the description and claims of the present invention, singular forms of "a", "an", and "the" are intended to include plural forms as well, unless the context clearly indicates otherwise. It should be further understood that the term "and/or" as used in the description and claims of the present invention refers to any and all possible combinations of one or more of the associated listed items and includes such combinations.

As used in the description and claims, the term "if" may be interpreted contextually as "when . . . " or "once" or "in response to a determination" or "in response to a detection". Similarly, the phrase "if it is determined" or "if a [described condition or event] is detected" may be interpreted contextually to mean "upon determining" or "in response to determining" or "upon detecting the [described condition or event]" or "in response to detecting the [described condition or event]".

Although the embodiments of the present invention are described above, they are only examples adopted for understanding the present invention, and are not intended to limit the scope and application scenarios of the present invention. Those skilled in art can make various variations and modifications to the present application in form and details without departing from the spirit and scope of the present application, but the scope of patent protection of the present invention is still defined by the appended claims.

What is claimed is:

1. An electronic percussion melody musical instrument, comprising:

a key module including a plurality of keys each arranged to receive a knock from the outside, and a plurality of energy conversion units each configured to sense mechanical energy generated by the knocking of the key and convert the mechanical energy into electrical energy in the form of an electrical signal, wherein the energy conversion unit comprises one or more of a piezoelectric ceramic sensor, a pressure sensitive sensor, a flexible bending sensor, and a vibration sensor;

a storage unit configured to store sound source data associated with the plurality of keys, wherein the storage unit comprises an integrated chip (IC) audio source memory and a data memory;

an output unit configured to output a sound signal corresponding to the sound source data, wherein the output unit comprises a speaker; and a control unit configured to:

receive the electrical signal from the energy conversion unit;

acquire the sound source data associated with the electrical signal from the storage unit according to the electrical signal; and control the output unit to output the sound signal corresponding to the sound source data, wherein the control unit comprises a digital signal processor, wherein the electronic percussion melody musical instrument further comprises a body configured to accommodate the control unit, the output unit, and the storage unit, the key module further includes a conductive structure, wherein the conductive structure includes a stress panel supporting the keys and a pressure-bearing bottom plate on one side of the body, the energy conversion unit is arranged between the stress panel and the pressure-bearing bottom plate; and the plurality of keys are arranged in at least two rows, wherein the first row is a semitone region and the second row is a whole tone region, and the keys are further arranged by one of:

a support arranged on the stress panel and configured to support and fix the keys; or the key includes a bottom surface fitting the stress panel and two side parts, wherein inner surfaces of the two side parts are in surface contact with end surfaces of the stress panel and the pressure-bearing bottom plate and are partially inserted into the body to support and fix the keys.

2. The electronic percussion melody musical instrument according to claim 1, wherein a vibration-proof material for preventing the energy conversion unit from vibrating is filled between the stress panel and the pressure-bearing bottom plate.

3. The electronic percussion melody musical instrument according to claim 2, further comprising a control panel and a power module, wherein the control panel is connected to the control unit and is configured to perform a function setting on the electronic percussion melody musical instrument, and the power module is configured to supply power to the electronic percussion melody musical instrument.

4. The electronic percussion melody musical instrument according to claim 1, further comprising an A/D conversion module configured to convert an analog electrical signal output from the energy conversion unit into a digital electrical signal and output the digital electrical signal to the control unit.

5. The electronic percussion melody musical instrument according to claim 4, further comprising a filtering module configured to filter the digital electrical signal and send the filtered digital electrical signal to the control unit.

6. The electronic percussion melody musical instrument according to claim 5, further comprising a control panel and a power module, wherein the control panel is connected to the control unit and is configured to perform a function setting on the electronic percussion melody musical instrument, and the power module is configured to supply power to the electronic percussion melody musical instrument.

7. The electronic percussion melody musical instrument according to claim 4, further comprising a control panel and a power module, wherein the control panel is connected to the control unit and is configured to perform a function setting on the electronic percussion melody musical instrument, and the power module is configured to supply power to the electronic percussion melody musical instrument.

8. The electronic percussion melody musical instrument according to claim 1, wherein the sound source data comprises data relating to timbre and/or sound effect of at least one musical instrument.

9. The electronic percussion melody musical instrument according to claim 8, wherein the at least one musical instrument comprises one or more of a xylophone, a vibraphone and a marimba.

10. The electronic percussion melody musical instrument according to claim 9, further comprising a control panel and a power module, wherein the control panel is connected to the control unit and is configured to perform a function setting on the electronic percussion melody musical instrument, and the power module is configured to supply power to the electronic percussion melody musical instrument.

11. The electronic percussion melody musical instrument according to claim 8, further comprising a control panel and a power module, wherein the control panel is connected to the control unit and is configured to perform a function setting on the electronic percussion melody musical instrument, and the power module is configured to supply power to the electronic percussion melody musical instrument.

12. The electronic percussion melody musical instrument according to claim 1, further comprising a transmission interface configured to enable the electronic percussion melody musical instrument to interact with an external device to provide extended functionality of the electronic percussion melody musical instrument, wherein the transmission interface comprises a wired transmission interface and/or a wireless transmission interface so as to provide a wired and/or wireless connection with the external device.

13. The electronic percussion melody musical instrument according to claim 12, further comprising a control panel and a power module, wherein the control panel is connected to the control unit and is configured to perform a function setting on the electronic percussion melody musical instrument, and the power module is configured to supply power to the electronic percussion melody musical instrument.

14. The electronic percussion melody musical instrument according to claim 1, further comprising a control panel and a power module, wherein the control panel is connected to the control unit and is configured to perform a function setting on the electronic percussion melody musical instrument, and the power module is configured to supply power to the electronic percussion melody musical instrument.

15. The electronic percussion melody musical instrument according to claim 1, further comprising a control panel and a power module, wherein the control panel is connected to the control unit and is configured to perform a function setting on the electronic percussion melody musical instrument, and the power module is configured to supply power to the electronic percussion melody musical instrument.

16. The electronic percussion melody musical instrument according to claim 1, further comprising a control panel and a power module, wherein the control panel is connected to the control unit and is configured to perform a function setting on the electronic percussion melody musical instrument, and the power module is configured to supply power to the electronic percussion melody musical instrument.

* * * * *